US007568862B2

(12) United States Patent
Buxton

(10) Patent No.: US 7,568,862 B2
(45) Date of Patent: Aug. 4, 2009

(54) PLUG MEMBER

(76) Inventor: Sean Peter Buxton, 22 Salisbury Street, Somerton Park, South Australia, 5004 (AU)

( * ) Notice: Subject to any disclaimer, the term of this patent is extended or adjusted under 35 U.S.C. 154(b) by 229 days.

(21) Appl. No.: 10/578,080

(22) PCT Filed: Nov. 7, 2003

(86) PCT No.: PCT/AU03/01468

§ 371 (c)(1),
(2), (4) Date: Jan. 29, 2007

(87) PCT Pub. No.: WO2005/045194

PCT Pub. Date: May 19, 2005

(65) Prior Publication Data

US 2007/0141297 A1 Jun. 21, 2007

(51) Int. Cl.
*E21D 20/02* (2006.01)

(52) U.S. Cl. ..... 405/259.5

(58) Field of Classification Search .... 405/259.1–259.7
See application file for complete search history.

(56) References Cited

U.S. PATENT DOCUMENTS 3,204,416 A * 9/1965 Williams ..... 405/259.3
3,379,019 A * 4/1968 Williams ..... 405/259.3
4,066,125 A * 1/1978 Bassani ..... 166/202
4,669,540 A * 6/1987 Luoma et al. ..... 166/135

FOREIGN PATENT DOCUMENTS

| | | |
|---|---|---|
| DE | 41 25 011 | 1/1993 |
| FR | 2 500 053 | 8/1982 |
| RU | 2 011 840 | 4/1994 |
| SU | 1046531 | 10/1983 |
| SU | 1081355 | 3/1984 |
| SU | 1375830 | 2/1988 |
| WO | WO 93/01362 | 1/1993 |
| ZA | 9308215 | 8/1994 |

* cited by examiner

*Primary Examiner*—John Kreck
(74) *Attorney, Agent, or Firm*—Bliss McGlynn, P.C.

(57) ABSTRACT

A plug member (10) for retaining grout in a cable bolt hole or a rockbolt hole or inside a rockbolt in underground excavations, comprising a cylindrical cap portion (20) with a means to wedge (26) the cap portion in the hole. The means to wedging means (26) may comprise a plurality of inclined flaps, a continuous resilient skirt, or a tapered bung. The cap portion (20) is provided with at least one port (50) to receive a grout delivery hose. The or each port (50) is comprised of a plurality of flexible flaps (56) moveable between an open position and a closed position. In the closed position the flaps (56) inter-engage to substantially close the port (50) and prevent grout leakage from the hole.

21 Claims, 2 Drawing Sheets

PLUG MEMBER

FIELD OF THE INVENTION

The present invention relates to a plug member for retaining grout in a cable bolt or rockbolt hole or inside a rockbolt in underground excavations typical of mining and civil engineering works.

BACKGROUND OF THE INVENTION

The support of large underground and civil excavations may require the use of any combination of "rockbolts", dowels and/or cables. For more permanent support where the support duties exceed the capacity of traditional "rockbolts and dowels", cable reinforcement is used. Where groundwater or corrosive conditions are present, support regimes using cables or rockbolts in conjunction with a cement or resin grout are used.

The properties of grouts, such as deformation modulus, uniaxial compressive strength and shear strength under normal stress, are variable according to the water/cement ratio of the grout. Typically, the ideal water/cement ratio of grouts for use with cable reinforcement lies in the range 0.30 to 0.35. Grout may be introduced into a cable bolt hole by using varying methods including the "collar-to-toe method" or the "toe-to-collar method".

In relation to the "collar-to-toe method", grout is injected into the entrance of the hole through a small diameter tube. A tube of similar diameter, known as a breather tube, extends to the other end of the hole alongside the accompanying cable. As grout travels through the hole, air is bled through the breather tube. When the hole is full of grout, the grout travels through the breather tube and back out the entrance of the hole.

In the "toe-to-collar method", a small diameter grout injection tube is pushed to the end of the hole and alongside the accompanying cable. The tube is then slowly displaced as the grout is pumped into the hole. This method does not require the use of a breather tube.

It is widely recognised that it is difficult to pump a high quality of grout into the hole using either of the two abovementioned methods. As a compromise, less viscous grouts are pumped into the holes which results in several unfortunate consequences. Firstly, a less viscous grout does not readily remain in the hole, resulting in lost grout through the hole entrance. Secondly, a high water/cement ratio grout reduces the overall capacity of a grouted cable. A further consequence of grout running out of the entrance of the cable hole is the increase in potential for spillage of grout onto personnel and equipment.

Excess grout may be prevented from running from the hole entrance by several plugging techniques and combinations thereof, including insertion of cotton wadding to fill gaps between the cables, tubes and hole; spraying an expanding foam into the hole entrance; and insertion of a wooden spad or plug in the hole entrance to jam the tubes and cable as tightly together as possible to minimise gaps. Alternatively, one must rely on a perfect, thixotropic grout to remain in situ.

The plugging methods described above have several limitations. The technique used to insert cotton wadding is slow and messy, and gaps may still remain around the cables and tubes from which grout may escape. Further to this, a small pressure buildup in the hole may cause the cotton wadding to be ejected out of the hole during the grouting process causing grout to spill out of the hole entrance. The hole then requires "replugging". Cotton wadding is easily wasted and is useless once it becomes wet or soggy. Foam sprays are generally very expensive and require a "curing period" before cables can be grouted, thus adding a further step in the whole procedure. Foams require special handling (e.g. use of gloves to avoid contact with the skin) and may also produce toxic fumes and are not recommended in areas of minimum ventilation. Further to this, foam sprays are very messy and often result in wastage. Wooden spads or plugs do not generally provide a tight seal.

The present invention attempts to overcome at least in part some of the aforementioned disadvantages.

SUMMARY OF THE INVENTION

In accordance with a first aspect of the present invention there is provided a plug member for retaining grout in a substantially cylindrical bore in underground excavations, comprising a cap portion provided with means to wedge the cap portion within the bore, and at least one port disposed in the cap portion, one port being arranged to receive a grout delivery means, wherein the or each port is comprised of a plurality of flexible flaps movable between an open position and a closed position, wherein in the open position the flaps engage an outer surface of the grout delivery means and in the closed position the flaps inter-engage to substantially close the or each port and substantially prevent leakage of grout through the or each port.

DESCRIPTION OF THE DRAWINGS

The present invention will now be described, by way of example, with reference to the accompanying drawings, in which.

DETAILED DESCRIPTION OF AN EMBODIMENT OF THE INVENTION

Figure 1:
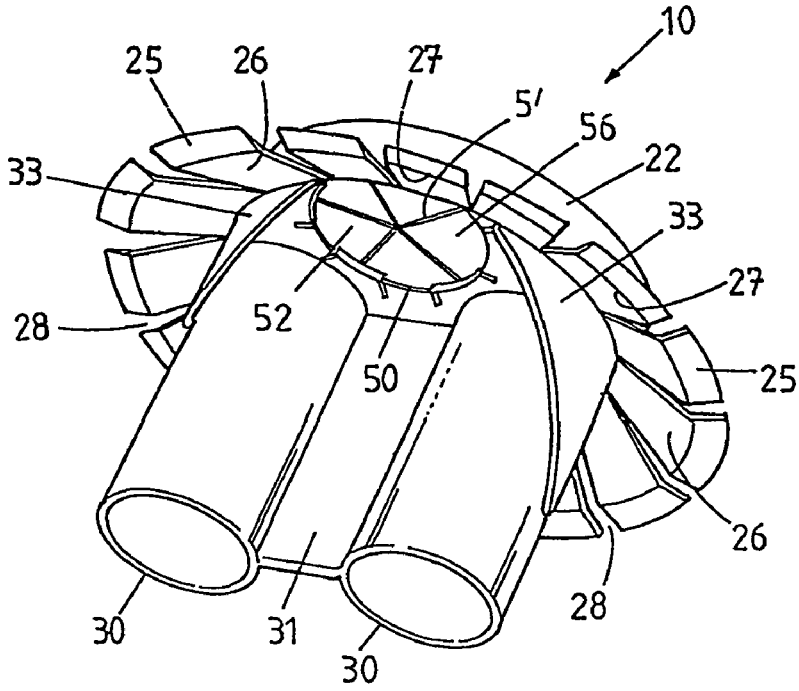
FIG. 1 is a diagrammatic lower perspective view of a plug member in accordance with the present invention.
Figure 2:
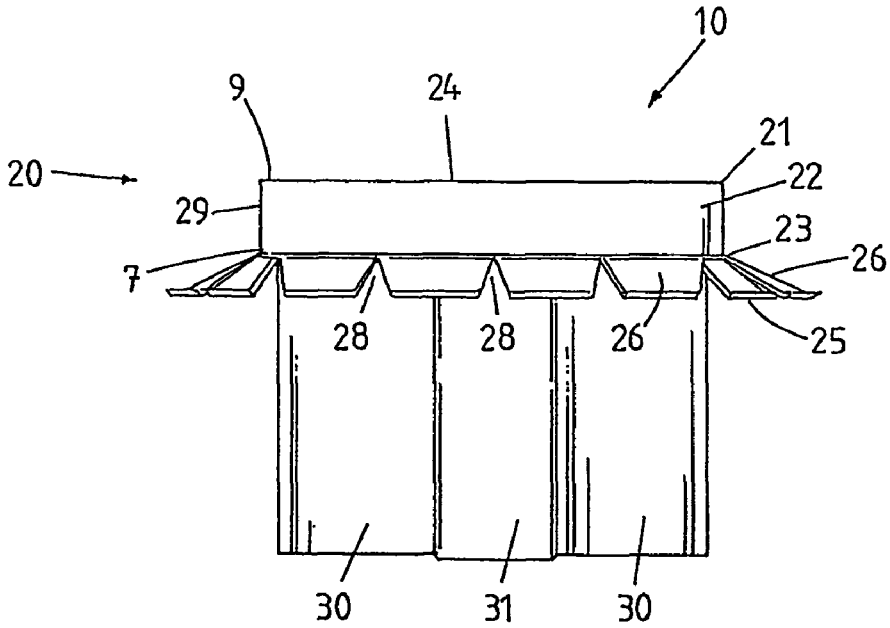
FIG. 2 is a diagrammatic side view of the plug member shown in FIG. 1.
Figure 3:
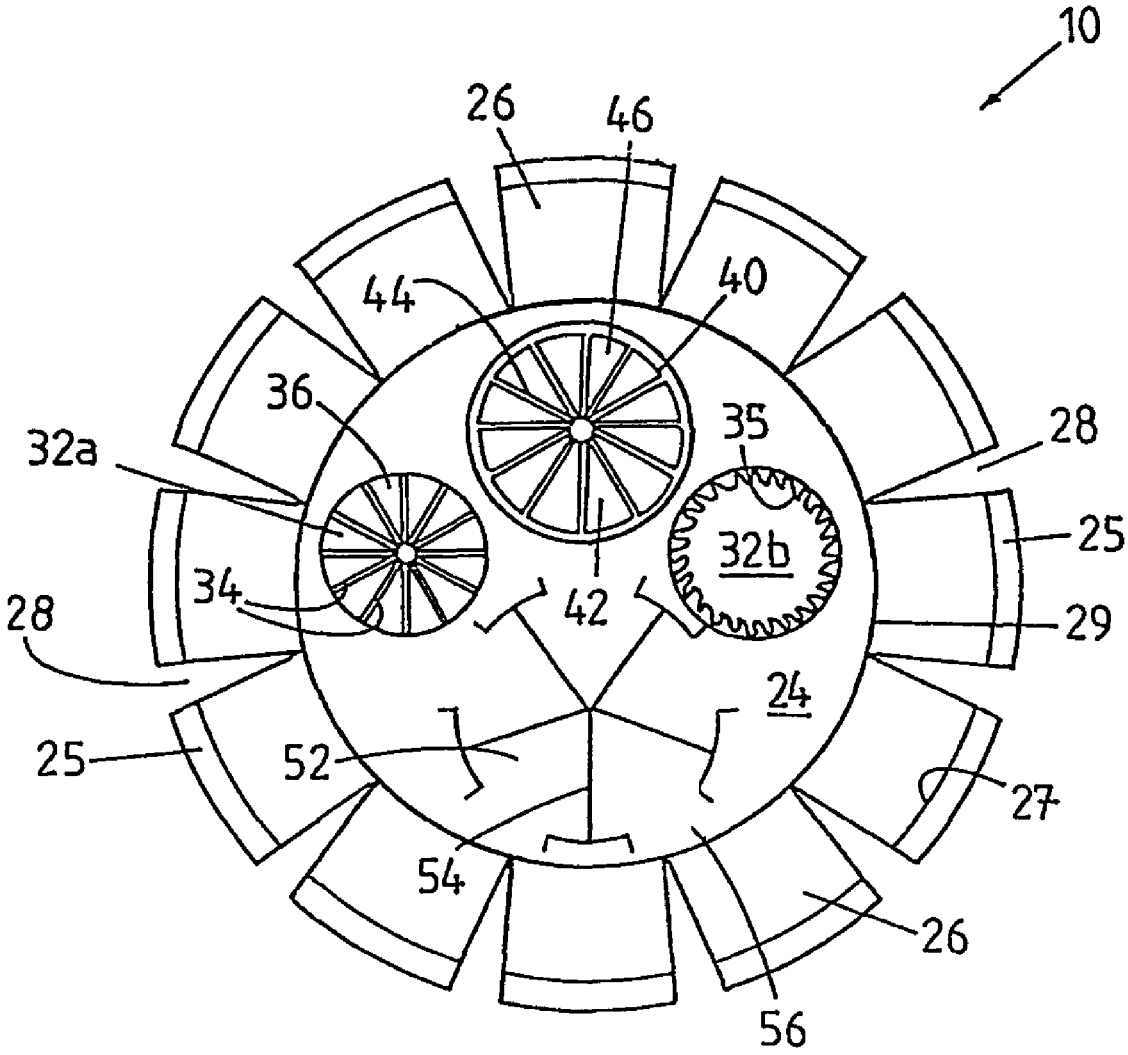
FIG. 3 is a diagrammatic top plan view of the plug member shown in FIGS. 1 and 2.

Referring to the Figures, wherein like numerals and symbols refer to like parts throughout, there is shown a plug member 10. The plug member 10 includes a cap portion 20 comprising a cylindrical portion 22 provided with a substantially flat wall 24 laterally extending across a circumferential rim 21 of a leading end 9 of the cylindrical portion 22 and a means to wedge the cap portion 20 within a cylindrical bore. It is envisaged that the cylindrical bore will be a rockbolt hole, a cable bolt hole, or a cylindrical bore of a rockbolt commonly known as a split set bolt.

Preferably, the cylindrical portion 22 has a diameter marginally smaller than a diameter of a cylindrical bore, typically ranging from 30-90 mm, such that an outer circumferential surface 29 of the cylindrical portion is substantially contiguous with or adjacent to a circumferential surface of the bore when the plug member 10 is placed inside the bore.

The means to wedge the cap portion within the bore preferably comprises a plurality of downwardly inclined flaps 26 depending from a circumferential rim 23 of an opposing end 7 of the cylindrical portion 22. However, the means to wedge the cap portion 20 within the bore may also comprise a plurality of flaps inclined at varying angles, a continuous resilient skirt, or a tapered bung.

The downwardly inclined flaps 26 are substantially rectangularly shaped and are equidistantly and equiangularly spaced around the circumferential rim 23 of the cylindrical portion 22 such that a gap 28 between adjacent flaps 26 is substantially triangularly shaped. Preferably, the gaps 28 are replaced by a thin triangularly shaped membrane extending between adjacent flaps 26. Each flap 26 is provided with an upwardly tilted flange 25 depending from its lowermost edge 27.

The plug member 10 also includes a pair of spaced cylindrical walls 30 depending substantially perpendicularly from the flat wall 24 of the cap portion 20. Preferably, the cylindrical walls 30 are disposed such that the cylindrical walls 30 are disposed adjacent to the circumferential rim 21 of the cylindrical portion 22. The spaced cylindrical walls 30 are interconnected by a web member 31, and are further stabilised with respect to the cap portion 20 by provision of respective ribs 33 interconnecting the cylindrical walls 30 to the cap portion 20. In use, the pair of spaced cylindrical walls are arranged to receive a pair of cable bolts.

A first portion 32*a* of the flat wall 24 enclosed by the cylindrical walls 30 is provided with a plurality of linear radial grooves 34 extending from a central axis of the first portion 32*a* and defining a plurality of triangular portions 36. In use, the first portion 32*a* is perforated along the linear grooves 34 such that the triangular portions 36 form and behave as flexible flaps.

A second portion 32*b* of the flat wall 24 enclosed by the cylindrical wall 30 is a circular aperture provided with a plurality of inwardly disposed serrations 35. The diameter of the aperture is selected such that the inwardly disposed serrations abut an outer circumferential surface of the cable bolt received therein.

It will be understood that in alternative embodiments of the invention the plug member 10 may be adapted to receive only one cable bolt, in which case the plug member 10 will be provided with only one cylindrical wall 30 having a first portion 32*a* or a second portion 32*b* as described above.

The circular plug member 10 also includes a first circular indentation 40 in the flat wall 24. A third portion 42 of the flat wall 24 enclosed by the first circular indentation 40 is provided with a plurality of linear radial grooves 44 extending from a central axis of the first circular indentation 40. The grooves 44 are equidistantly and equiangularly spaced around the first circular indentation 40 such that the first circular indentation 40 is segmented into substantially equal sized triangular portions 46. In use, the third portion 42 is perforated along the grooves 44 such that the triangular portions 46 form and behave as flexible flaps.

The plug member 10 further includes a second circular indentation 50 in the flat wall 24. A fourth portion 52 of the flat wall 24 enclosed by the second circular indentation 50 is provided with a plurality of linear radial grooves 54 extending from a central axis of the second circular indentation 50. The grooves 54 are equidistantly and equiangularly spaced around the second circular indentation 50 such that the second circular indentation 50 is segmented into substantially equal sized triangular portions 56. The second circular indentation 50 is also provided with a plurality of arc-shaped grooves disposed around the second circular indentation 50 such that the arc-shaped grooves are bisected by the linear radial grooves 54. In use, the fourth portion 52 is perforated along the grooves 54 and the arc shaped grooves such that the triangular portions 56 form and behave as flexible flaps. Typically, the triangular portions 56 are more flexible than the triangular portions 36, 46.

It will be understood that the grooves 34, 44, 54 may also take the form of a series of perforations formed in a similar pattern to define triangular portions 36, 46, 56.

When pierced or perforated, the triangular portions 36, 46, 56 are movable between an open position and a closed position. The inherent tendency of the triangular portions 36, 46, 56 is towards the closed position. When a hose or cable bolt is received in the first portion 32*a* or the first or second circular indentations 40, 50 in the cap portion 22, the triangular portions 36, 46, 56 are urged to move to the open position wherein the triangular portions 36, 46, 56 engage with an outer surface of the hose or cable bolt received therein. In this way, the first portion 32*a*, and the first and second circular indentations 40, 50 are adapted for use as self-closing ports in the cap portion 22.

Preferably, the plug member 10 is formed from a resilient plastics material, a semi rigid plastics material, or a natural or synthetic rubber material.

In use, the cylindrical portion 22 of the cap portion 20 is placed inside the entrance of a cable bolt hole or rockbolt hole or inside a rockbolt of about 30-90 mm in diameter, such that the flat wall 24 is disposed as a leading face in the hole and a portion of the cylindrical walls 30 extends from the entrance. In this arrangement, the outer circumferential surface 29 of the cylindrical portion 22 is substantially contiguous with or adjacent to the circumferential surface of the hole. Upon insertion of the cylindrical portion 22, the flaps 26 depending from the circumferential rim 23 of the cylindrical portion 22 will be caused to flex towards the cylindrical portion 22 to a greater or lesser degree, depending on the diameter of the hole, thereby minimising the gaps 28 between adjacent flaps 26 from which grout may leak. In the instances where the gaps 28 are replaced by thin membranes it is envisaged that little or no grout would leak from the hole entrance. The inherent tendency of the flaps 26 is to resist any inward inclination towards the cylindrical portion 22, and thus the flaps 26 exert a circumferential force on the circumferential surface of the hole which enables the plug member 10 to remain firmly wedged within the hole despite back pressure exerted by the grout on the flat wall 24 of the cylindrical portion 22. Typically, the minimal weight of grout bearing down on the plug member 10 from inside the hole is up to about 50 kg.

One or more cable tails with one or more grout tubes optionally attached thereto can be readily inserted through the cylindrical walls 30 of the plug member 10 by piercing the grooves 34 found in the first portion 32*a* of the flat wall 24 and/or engaging the serrations 35 of the second portion 32*b* in a friction fit The triangular flaps 36 tightly enclose around the cables and tubes, minimizing any gaps arising therebetween. The triangular flaps 36 also provide a frictional force between the cables, and the plug member 10 to assist in maintaining the plug member 10 in the hole during the grouting process.

The cylindrical walls 30 that depends around the periphery of the first and second portions 32*a*, and 32*b* assists in the orientation of the cable/grout tube combination away from the circumferential surface of the hole, thereby enabling the grout to completely fill the void between the cable bolt and the circumferential surface of the hole and ensure optimum structural strength.

The cylindrical walls 30 are also advantageously arranged to provide stability, stiffness, and minimise torsion of the plug member 10, so providing a gripping point for the plug member 10 as it is inserted into the hole or as the cables and tubes are inserted into the plug member 10. The cylindrical walls 30 may also be gripped as the plug member 10 is slid along one or more cable bolts.

A polyethylene hose or similar (known as a grout hose) is then inserted through the fourth portion 52 of the flat wall 24 by piercing the linear radial grooves 54, and grout is delivered into the hole by either of the two methods described above. The resulting triangular flaps 56 closely grip the outer circumferential surface of the grout hose, however the flexibility of the flaps 56 allow the grout hose to be slid in and out of the hole such that it may be inserted into the full extent of the hole. As the grouting procedure continues, the grout hose may be retracted back through the fourth portion 52 until it is completely removed from the plug member 10 and the hole. The flexibility of the triangular flaps 56 is such that the flaps 56 are arranged to close behind the grout hose to prevent excess grout from leaking from the plug member 10. In alternative grouting methods, the grout hose may be inserted merely a short length into the hole through the plug member 10 and remain stationary during the grouting procedure. In this case, upon completion, the grout hose is typically "crimped off" and left in situ in the plug member 10. In either method the plug member 10 may remain in the entrance of the hole while the grout cures.

A breather tube or hose may also be inserted through the third portion 42 of the flat wall 24 by piercing the linear radial grooves 44. The resulting triangular flaps 46 closely grip the outer circumferential surface of the breather tube. When the breather tube remains inside the hole alongside the cable bolt, the flexibility of the triangular flaps 46 is such that the flaps 46 are arranged to close tightly around the breather tube to prevent grout leaking from the hole.

The plug member 10 could also be used inside a cylindrical bore of a rockbolt commonly known as a split set bolt.

The plug member 10 of the present invention is arranged to replace existing plugging methods used in the mining industry, the construction industry, or in the civil works industry, when grouting cable bolt holes that lie at any angle above the horizontal. Its use, as described above, enables a one step, simple installation technique that is more efficient than other known plugging methods. The advantageous design of the plug member 10 further reduces gaps from which grout can leak in comparison to other plugging techniques, thus reducing grout spillage. A reduction in grout spillage consequently improves housekeeping on a work platform, reducing the potential for grout burns on workers, maintenance on the work platform and the cost of lost grout. The plug member 10 is lighter, more durable and easier to handle than other plugging materials. Further, it is easier and cheaper to store and transport in comparison to other plugging methods and their associated devices.

Modifications and variations as would be apparent to a skilled addressee are deemed to be within the scope of the present invention. For example, the flat wall 24 of the cap portion 20 may be readily replaced by a curved convex or concave wall laterally extending across an uppermost circumferential rim 21 of the cylindrical portion 22.

The invention claimed is:

1. A plug member for retaining grout in a substantially cylindrical bore in underground excavations, characterised in that the plug member comprises a cap portion arranged to engage with walls of the bore, the plug member including means to wedge the cap portion within the bore, the cap portion including at least one aperture arranged to receive a load bearing member in a close fit, the at least one aperture is substantially bounded by at least one resilient member, the at least one resilient member acting, in use, against the load bearing member to substantially prevent the leakage of grout, wherein the at least one resilient member comprises an enclosing means whereby the enclosing means substantially prevents the leakage of grout through the aperture when a load bearing member is not present, and the cap portion including at least one port arranged to receive a grout delivery means in a close fit, and a further port through which air may be vented.

2. A plug member as claimed in claim 1, characterised in that at least one port is substantially bounded by at least one resilient member, the resilient member acting, in use, against the grout delivery means or air venting means to substantially prevent the leakage of grout.

3. A plug member as claimed in claim 2, characterised in that the at least one resilient member comprises an enclosing means whereby the enclosing means substantially prevents the leakage of grout through the port when a grout delivery means or air venting means is not present.

4. A plug member as claimed in claim 1, characterised in that the enclosing means is comprised of a plurality of flexible flaps moveable between an open position and a closed position, wherein in the open position the flaps are engagable with an outer surface of the load bearing member, grout delivery means or air venting means and in the closed position the flaps inter-engage to substantially close the or each aperture or port and substantially prevent leakage of grout through the or each aperture or port.

5. A plug member as claimed in claim 1, characterised in that the cap portion comprises a cylindrical portion provided with a lateral wall extending across a first circumferential rim of a leading end of the cylindrical portion.

6. A plug member as claimed in claim 5, characterised in that the lateral wall is curved concave or curved convex.

7. A plug member as claimed in claim 1, characterised in that the means to wedge the cap portion within the bore comprises a continuous resilient skirt.

8. A plug member as claimed in claim 1, characterised in that the means to wedge the cap portion within the bore comprises a tapered bung.

9. A plug member as claimed in claim 5, characterised in that the means to wedge the cap portion within the bore comprises a plurality of downwardly inclined flaps depending from a second circumferential rim of an opposing end of the cylindrical portion.

10. A plug member as claimed in claim 9, characterised in that the downwardly inclined flaps are substantially rectangularly shaped and are equidistantly and equiangularly spaced around the second circumferential rim such that a gap between adjacent flaps is substantially triangularly shaped.

11. A plug member as claimed in claim 10, characterised in that a thin triangularly shaped membrane extends between adjacent flaps.

12. A plug member as claimed in claim 9, characterised in that each flap is provided with an upwardly tilted flange depending from its lowermost edge.

13. A plug member as claimed in claim 5, characterised in that any number of spaced cylindrical walls depend substantially perpendicularly from the lateral wall extending across the first circumferential rim of the cylindrical portion.

14. A plug member as claimed in claim 13, characterised in that the cylindrical walls are disposed adjacent to the first circumferential rim.

15. A plug member as claimed in claim 13, characterised in that the cylindrical walls are interconnected by a web member.

16. A plug member as claimed in claim 13, characterised in that the cylindrical walls are provided with respective ribs to stabilise the cylindrical walls with respect to the cap portion.

17. A plug member as claimed in claim 13, characterised in that the cylindrical wall defines a circular portion of the lateral wall, the circular portion being provided with a plurality of linear radial grooves extending from a central axis of the circular portion, thereby defining a plurality of triangular portions, whereby the grooves are adapted to be perforated or piercable such that the triangular portions form and behave in use as flexible flaps.

18. A plug member as claimed in claim 13, characterised in that the cylindrical wall defines a circular aperture in the lateral wall, the circular aperture being provided with a plurality of inwardly extending serrations.

19. A plug member as claimed in claim 5, characterised in that the or each port is disposed in the lateral wall of the cap portion.

20. A plug member as claimed in claim 17, wherein the flexible flaps are substantially equal sized triangular portions spaced equiangularly within a circular indentation in the cap portion.

21. A plug member as claimed in claim 1, characterised in that the plug member is formed from a semi-rigid material.

* * * * *